US005826549A

United States Patent [19]

Martin

[11] Patent Number: 5,826,549

[45] Date of Patent: Oct. 27, 1998

[54] TANDEM FAN FOR MOTOR-VEHICLE RADIATORS

[75] Inventor: Hans Martin, Stuttgart, Germany

[73] Assignee: Behr GmbH & Co., Stuttgart, Germany

[21] Appl. No.: 749,927

[22] Filed: Nov. 14, 1996

[30] Foreign Application Priority Data

Dec. 6, 1995 [DE] Germany ..... 195 45 390.5

[51] Int. Cl.[6] ..... F01P 7/02

[52] U.S. Cl. ..... 123/41.11; 123/41.49; 165/121; 165/DIG. 307

[58] Field of Search ..... 123/41.11, 41.12, 123/41.49; 165/41, 121, DIG. 307; 415/61; 416/169 A

[56] References Cited

U.S. PATENT DOCUMENTS

| | | | |
|---|---|---|---|
| 3,853,098 | 12/1974 | Ishikawa et al. | 123/41.11 |
| 3,882,951 | 5/1975 | Conley | 123/41.49 |
| 4,757,858 | 7/1988 | Miller et al. | 165/41 |

FOREIGN PATENT DOCUMENTS

| | | | |
|---|---|---|---|
| 0 100 039 | 2/1984 | European Pat. Off. . | |
| 0 259 182 | 3/1988 | European Pat. Off. . | |
| 23 49 945 | 4/1974 | Germany . | |
| 2931306 | 2/1981 | Germany | 123/41.12 |
| 32 47 165 | 6/1984 | Germany . | |
| 42 41 804 | 6/1994 | Germany . | |
| 44 01 979 | 7/1995 | Germany . | |

*Primary Examiner*—Noah P. Kamen
*Attorney, Agent, or Firm*—Foley & Lardner

[57] ABSTRACT

A tandem fan for a motor-vehicle radiator has one fan impeller driven via a fluid friction clutch by the engine shaft. Both fan impellers have belt pulleys with a common driving belt. Overrunning clutches for the two fan impellers ensure the impellers are driven by the drive shaft which is running faster.

6 Claims, 6 Drawing Sheets

TANDEM FAN FOR MOTOR-VEHICLE RADIATORS

BACKGROUND OF THE INVENTION

The present invention relates to a tandem fan for a motor-vehicle radiator comprising two fan impellers, which are each provided with a belt pulley. The two impellers are arranged parallel to one another and the belt pulleys are coupled to one another by a common belt. An electric motor is provided as a drive.

German Patent 44 01 979 A1 discloses a known arrangement for a single fan drive having a fluid friction clutch driven from the engine with an additional electric-motor drive. The electric-motor drive increases the fan speed, especially at low engine speeds, via a one-way clutch.

Tandem fans are also known. German Patent 42 41 804 C2 discloses a tandem fan for the condenser of an air-conditioning system in a motor vehicle. Such a known fan can be installed in a restricted space, having the advantage that it is of very low-height construction. However, a disadvantage of such known fans is that, for high fan outputs, a powerful electric motor is required which is very large and very heavy. It is therefore not possible to use such known tandem fans to obtain sufficient cooling for an engine radiator in which a low-height type of construction is desirable because of the increasing tendency in modern vehicle designs toward lower and lower engine hoods and smaller and smaller installation spaces.

SUMMARY OF THE INVENTION

It is therefore one object of the present invention to provide an improved design for a tandem fan.

The present invention goes beyond the known designs by providing an electric motor for driving a second fan impeller, and by coupling the two fan impellers together via one-way clutches.

A particular object of the invention is to provide a tandem fan for use with engine radiators which does not require an electric motor that is too large and requires too much electric power.

In accomplishing these and other objects, there has been provided in accordance with the present invention a tandem fan for a motor-vehicle radiator, comprising: two fan impellers provided with a belt pulley, the fan impellers having axles arranged parallel to one another and the belt pulleys thereof being coupled to one another by a common belt; an electric motor having a belt pulley for driving the common belt; a fluid friction clutch for driving one of the two fan impellers via a shaft of the vehicle motor, and respective overrunning clutches arranged between the drive shaft of the fluid friction clutch and the associated belt pulley and between the drive shaft of the electric motor and the belt pulley associated with the electric motor.

Further objects, features and advantages of the present invention will become apparent from the detailed description of preferred embodiments that follows, when considered together with the attached drawing figures.

Brief Description of the Drawings The invention is illustrated in the drawings by means of exemplary embodiments, as explained below. In the drawings.

DETAILED DESCRIPTION OF THE PREFERRED EMBODIMENTS

According to the invention, a tandem fan is provided having one of the two fan impellers driven by the engine shaft via a fluid friction clutch of a type known per se.

Overrunning clutches are arranged between the drive shaft of the fluid friction clutch and the associated belt pulley, and between the drive shaft of an electric motor and the belt pulley associated with the electric motor.

According to one embodiment of the invention, an electric motor is associated with one of two fan impellers, and the other fan impeller is driven by way of a fluid friction clutch driven by the vehicle engine. It is also possible to pass the belt over a tensioning roller, which can be arranged in the region outside the diameters of the fan impellers. This keeps down the height of this design even though a tensioning device is provided for the belt drive. The tensioning roller can also be designed as a belt pulley driven by an electric motor, whereby the electric motor associated directly with the fan impellers, as a drive, is then omitted.

As a further embodiment of the invention, it is also possible for the fluid friction clutch to be driven from the engine by way of a flexible coupling, making the arrangement free of engine vibration. In this mode of construction, both fan impellers can be integrated into a radiator cowl, which is secured in a known manner with respect to the engine compartment, together with the radiator.

It is also possible to support both fan impellers, together with their drives, with respect to the engine, and to assign to them a movable radiator cowl. However, in this mode of construction, it is not possible to avoid the occurrence of a gap between the cowl and the periphery of the fan impellers, which can lead to unwanted flow effects.

Figure 1:
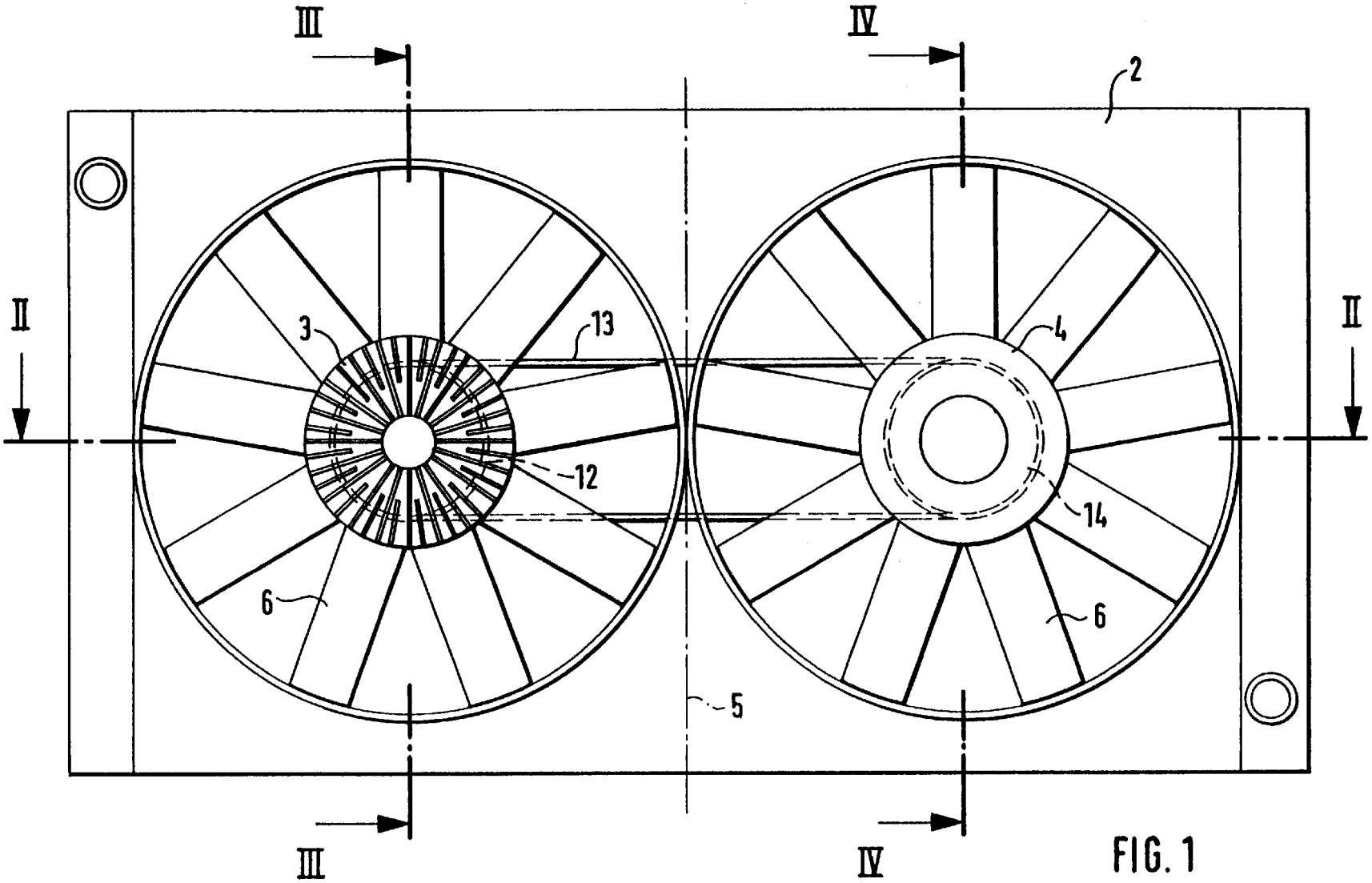
FIG. 1 is a schematic view of the drive side of a tandem fan in accordance with the invention.
Figure 2:
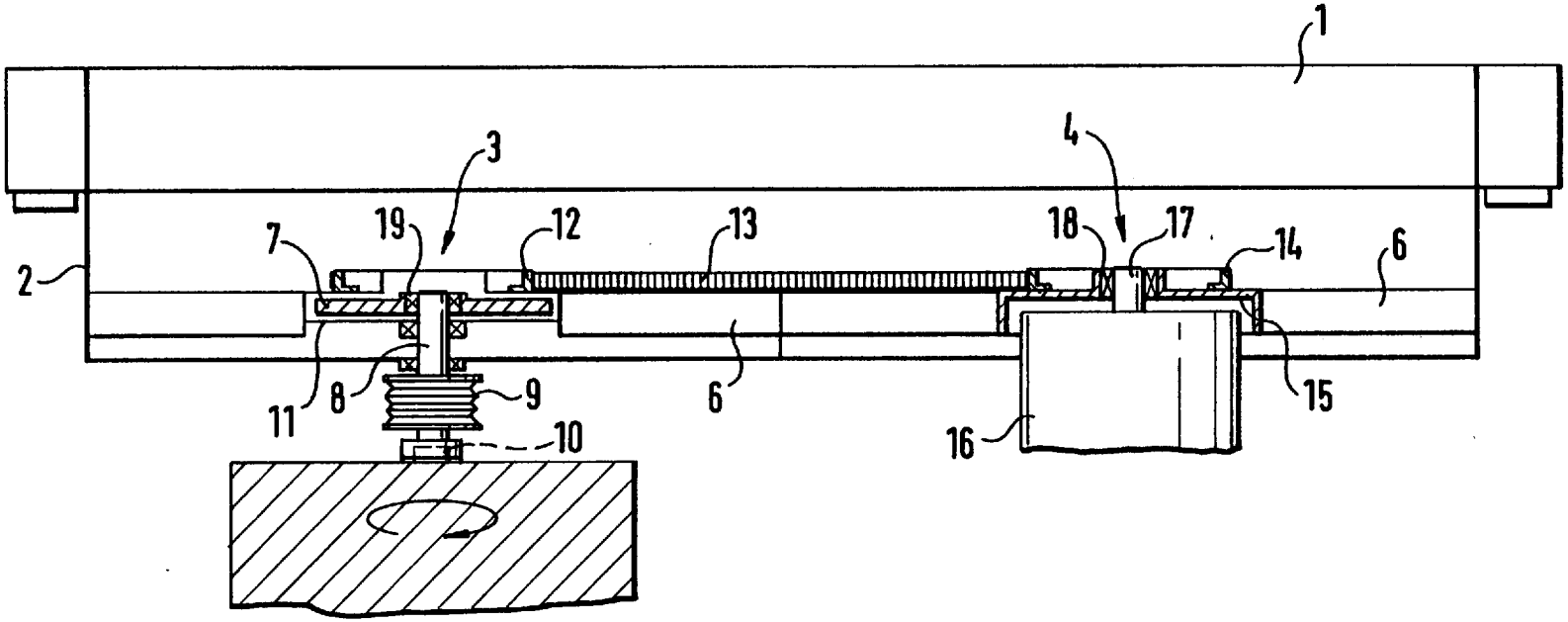
FIG. 2 is a sectional view taken through the tandem fan of FIG. 1 along the line II—II.
Figure 3:
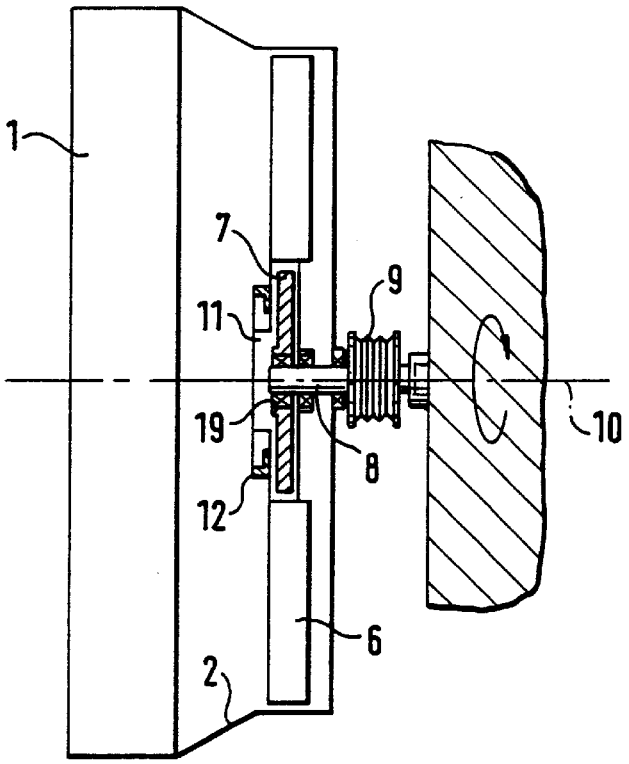
FIG. 3 is a sectional view taken through the tandem fan of FIG. 1 along the line III—III.
Figure 4:
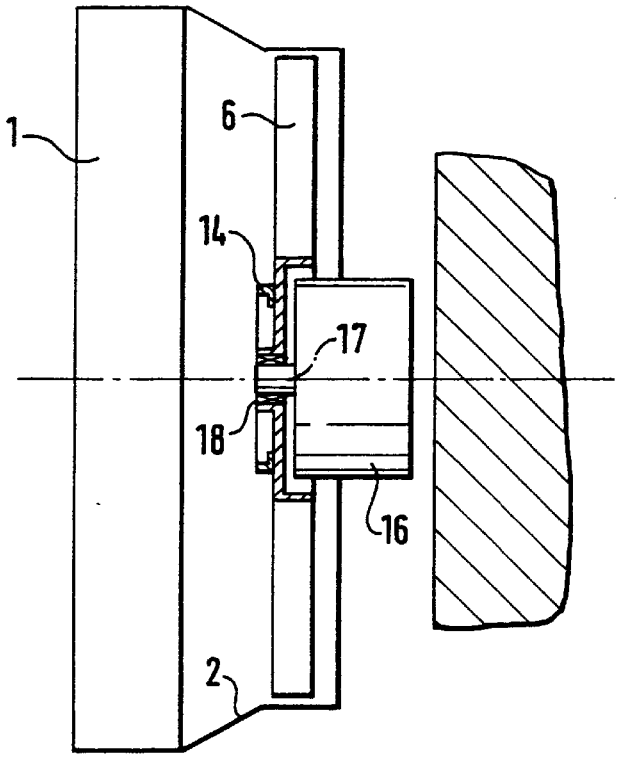
FIG. 4 is a sectional view taken through the tandem fan of FIG. 1 along the line IV—IV.

Referring now to the drawings, in FIGS. 1 to 4, a tandem fan is arranged within a fan cowl (2) associated with the radiator (1) of a motor-vehicle engine (not shown). The tandem fan consists of two fan impellers (3 and 4) which are arranged with their axes of rotation parallel and adjacent to one another, and arranged symmetrically with respect to a plane (5) placed in the center through the radiator (1). The fan impeller (3) with the blades (6) is driven by means of a driving pulley (7) via a fluid friction clutch. As best shown in FIG. 2, the driving pulley (7) is driven by means of its drive spindle (8) via a flexible coupling (9) being driven by the engine shaft (10). The housing (11) of the fluid friction clutch, to the outside of which fan impeller (3) is attached, is provided with a belt pulley (12) which cooperates with a toothed belt (13), for example. Toothed belt (13) also cooperates with a further belt pulley (14) associated with the hub (15) of fan impeller (4), which can be driven by way of an electric motor (16). Seated between the drive shaft (17)

of the electric motor (16) and the belt pulley (14) connected rigidly to the hub (15) is an overrunning clutch (18).

In a similar manner, a one-way clutch (19) is arranged between the drive shaft (8) of the fluid friction clutch and the driving pulley (7) of the fluid friction clutch. Both one-way clutches (18 and 19) are designed in such a way that the associated driven part, i.e., the housing (11) of the fluid friction clutch and the hub (15) of fan impeller (4), respectively, are each driven from the side rotating at a higher speed. Such one-way clutches, which are also known as sleeve-type one-way clutches, are commercially available. The action of these sleeve-type one-way clutches is based on a number of needle-shaped rolling-contact or jamming elements distributed over the circumferential surface of the clutch confronting the output shaft (17) of the electric motor or the drive shaft (8) of the fluid friction clutch. If a shaft then rotates faster than its respective circumferential surface, the one-way clutch locks-up and the drive is transmitted via the drive shaft which is running faster. Therefore, if the engine speed is high enough - as will be explained with reference to FIG. 7 - the two fan impellers (3 and 4) are driven via the fluid friction clutch (8, 11). If the engine speed is low, the electric motor (16) assumes the task of driving the two fan impellers (3 and 4).

Figure 5:
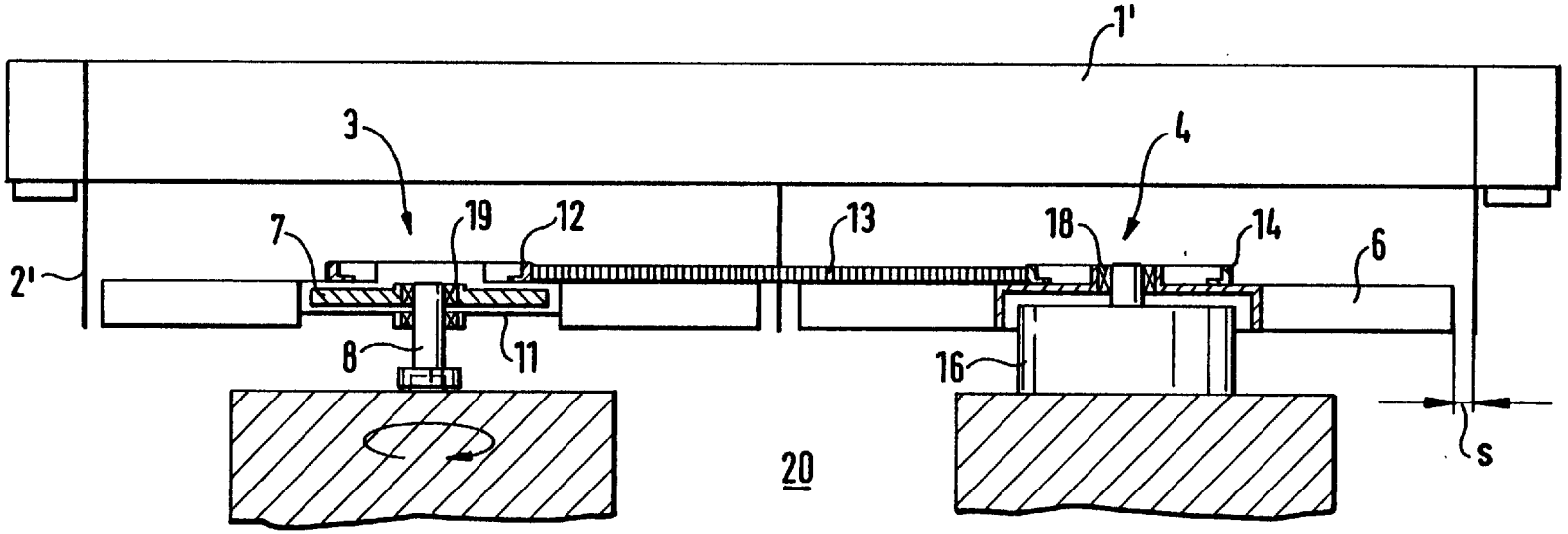
FIG. 5 is a sectional view similar to FIG. 2 of a tandem fan differing from that shown in FIG. 1 in that the fan impellers are arranged so as to be supported by the engine.
Figure 6:
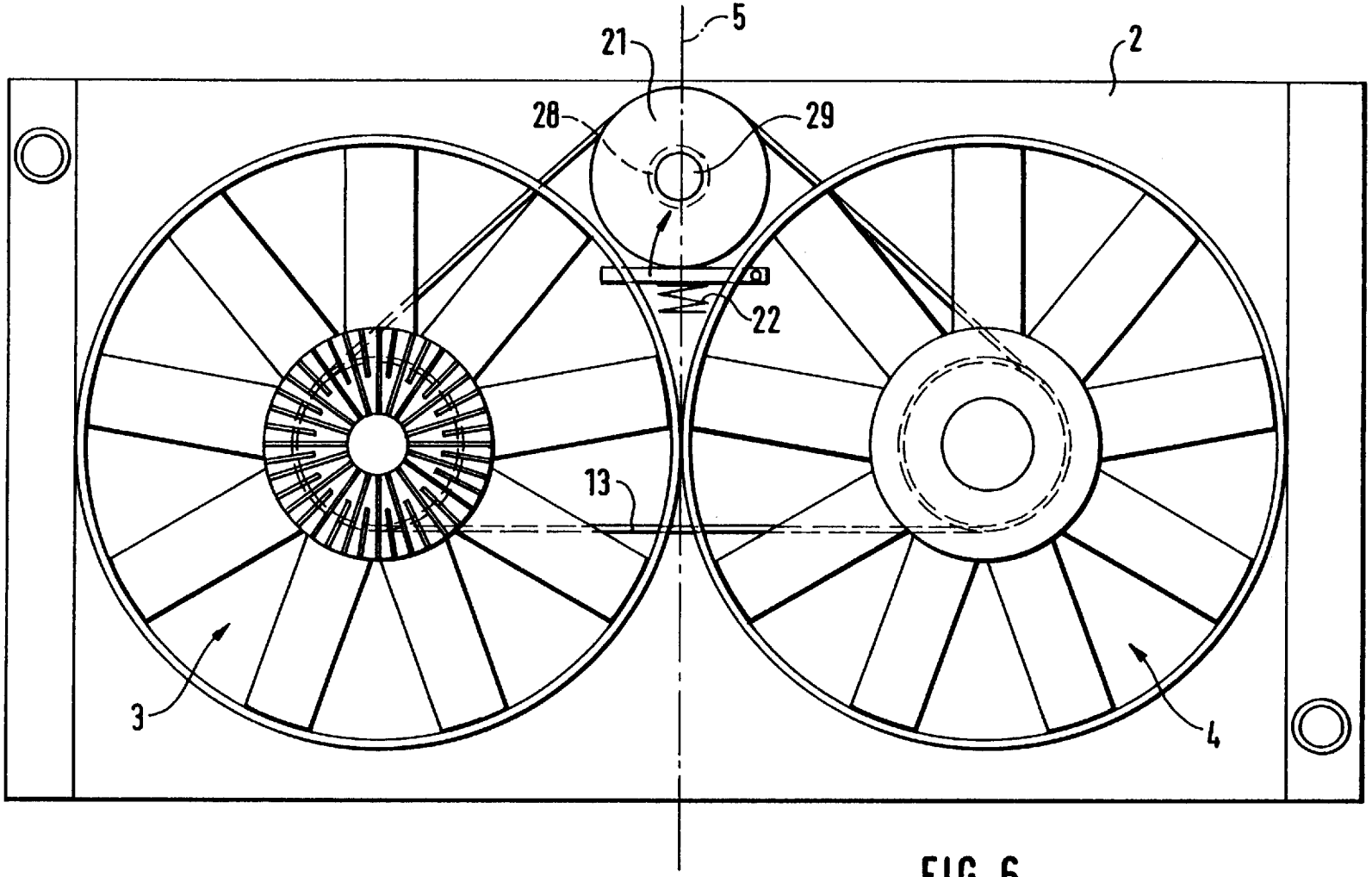
FIG. 6 is a schematic view of a tandem fan in accordance with the invention but with an additional tensioning roller.

The same operation also applies to a design in accordance with FIGS. 5 or 6. In the case of the design shown in FIG. 5, the electric motor (16) and the drive shaft (8) of the fluid friction clutch are fastened in a fixed location with respect to the engine (20), and the cowl (2'), which is rigidly connected to the radiator (1'), is secured independently with respect to the engine compartment. The gap(s) between the fan impellers (3 and 4) and the cowl (2') necessary with this design can lead to disturbances in the flow conditions due to vortices.

In the case of the design in FIG. 6, the drive belt (13) that drivingly connects the fan impellers (3 and 4) to one another, is additionally passed over a tensioning roller (21). The tensioning roller (21) is mounted in the center plane (5) in such a way that it lies outside the diameter of the fan impellers (3 and 4). In the case of this design, the tensioning roller (21), which is acted upon by the force of a spring (22), is at all times able to ensure satisfactory contact between the belt (13) and the associated belt pulleys (12 and 14), and hence satisfactory running of both fan impellers (3 and 4). It is also possible to design the tensioning roller (21) as a driving pulley for the belt, in which case the tensioning roller is driven by an electric motor (not shown). In this case - which is indicated with broken lines in FIG. 7 - a one-way clutch (28) replaces the one-way clutch (18) associated with the electric motor (16) in the exemplary embodiment shown in FIG. 2 and FIG. 6. The one-way clutch (28) is provided between the output shaft (29) of the electric motor and the tensioning roller (21). Thus, the electric motor for directly driving fan impeller (4) is omitted in the exemplary embodiment in FIG. 6.

Figure 7:
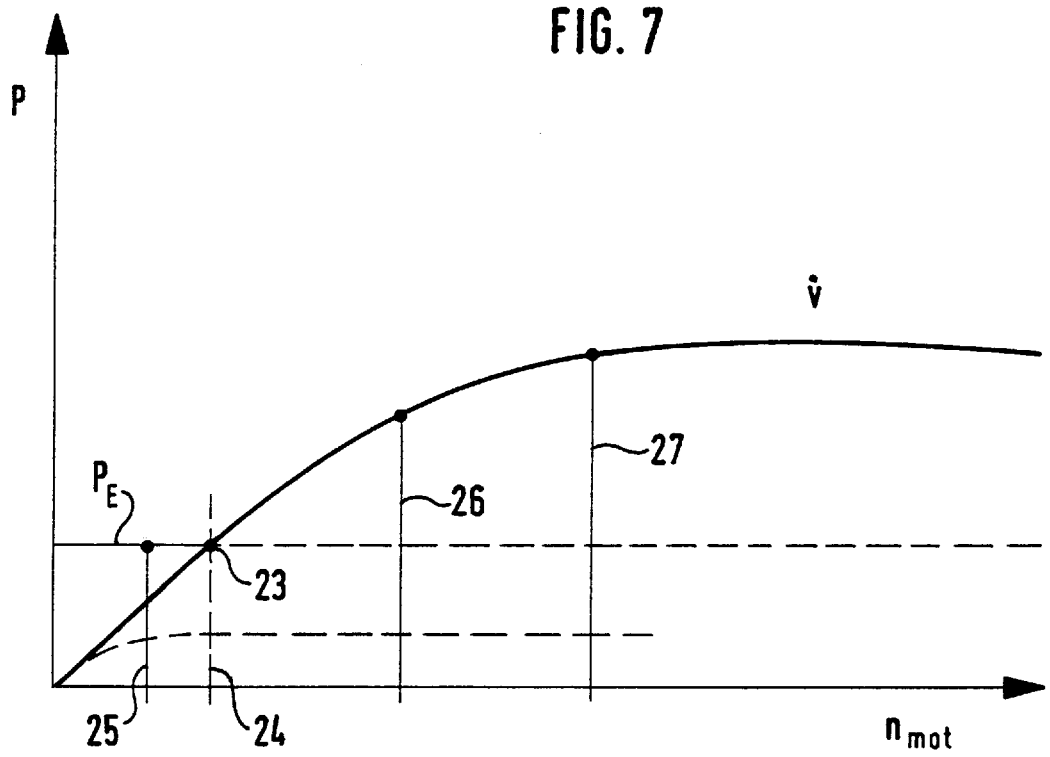
FIG. 7 is a diagrammatic representation of the quantity of air supplied by the tandem fan according to the invention as a function of the engine speed.

FIG. 7 shows that the quantity of air ($\dot{v}$) required for adequate cooling of the engine can be supplied as a function of the engine speed ($n_{mot}$) by the various drives associated with the tandem fan in accordance with the invention.

For example, if an electric motor (16) with a power of about 350W is provided, the fan output (P) necessary up to the quantity of air ($\dot{v}$) denoted at 23 can be supplied by the electric motor (16) alone. That is, the fan output ($P_E$) supplied exclusively by the electric motor (16) up to a low engine speed, for example the idling speed (25) an even higher engine speed (24). As is also shown by FIG. 7, it is not necessary to supply additional electric power to the electric motor (16) above the engine speed (24) because the fluid friction clutch assumes the task of driving the entire tandem fan. Above the engine speed (24), power is no longer taken from the vehicle electrical system. The required quantity of air ($\dot{v}$) for engine cooling, for example, at a speed of 20 km/h, which is indicated at (26), or at 60 km/h, which is indicated at (27), can be supplied exclusively via the fluid friction clutch, which drives both fan impellers (3 and 4). Driving the fan impellers (3 and 4) via either the fluid friction clutch or the electric motor ensures adequate air flow through the radiator, and can also be used in a restricted installation space (i.e. low overall height and small overall depth). The electric motor (16), which requires relatively little power, is chosen so that the power required to be provided for a prolonged period by a vehicle electrical system of a conventional kind, is likewise very small. As has been explained with reference to FIG. 7, it is not necessary to provide a high power electric motor for a tandem fan arrangement according to the invention.

Although the invention has been described and explained with reference to only a limited number of preferred embodiments, those skilled in the art will realize that various changes, substitutions and/or modifications are possible within the basic concept of the present invention. It is intended that all embodiments of the invention resulting from such changes, substitutions and/or modifications shall be covered by the appended claims.

What is claimed is:

1. A tandem fan for a radiator of a motor driven vehicle, comprising: two fan impellers having respective belt pulleys, said fan impellers having respective axes of rotation arranged parallel to one another, and the respective belt pulleys being coupled to one another by a common belt; an electric motor for driving said common belt; a fluid friction clutch for driving one of the two fan impellers, the fluid friction clutch being driven via a first overrunning clutch by the vehicle motor; and a second overrunning clutch arranged between the electric motor and its respective belt pulley; wherein electric motor is coaxial with one of the two fan impellers and wherein the other fan impeller is coaxial with the fluid friction clutch.

2. A tandem fan as claimed in claim 1, further comprising a tensioning roller and wherein the belt is passed over said tensioning roller.

3. A tandem fan as claimed in claim 2, wherein the tensioning roller is arranged outside the diameter of the two fan impellers.

4. A tandem fan as claimed in claim 1, further comprising a flexible coupling interposed between the fluid friction clutch and the vehicle motor.

5. A tandem fan as claimed in claim 1, wherein the electric motor has a power supply requirement such that it can be operated for a prolonged period by a standard vehicle electrical system.

6. A tandem fan for a radiator of a motor driven vehicle, comprising: two fan impellers having respective belt pulleys, said fan impellers having respective axes of rotation arranged parallel to one another and the respective belt pulleys being coupled to one another by a common belt; an electric motor for driving said common belt; a fluid friction clutch for driving one of the two fan impellers, the fluid friction clutch being driven via a first overrunning clutch by the vehicle motors; a second overrunning clutch arranged between the electric motor and its respective belt pulley; and a radiator cowl supported in a fixed manner with respect to the radiator; wherein the electric motor and the fluid friction clutch are supported in a fixed manner with respect to the vehicle motor such that the fan impellers are relatively movable with respect to the radiator cowl.

* * * * *